US011754092B2

(12) United States Patent
Zwahlen et al.

(10) Patent No.: US 11,754,092 B2
(45) Date of Patent: Sep. 12, 2023

(54) RADIAL TURBOMACHINE

(71) Applicant: Micronel AG, Tagelswangen (CH)

(72) Inventors: Ronny Zwahlen, Zurich (CH); Daniel Hilpert, Schaffhausen (CH); Peter Meier, Fehraltorf (CH); Ernst Scherrer, Winterthur (CH)

(73) Assignee: Micronel AG, Tagelswangen (CH)

( * ) Notice: Subject to any disclaimer, the term of this patent is extended or adjusted under 35 U.S.C. 154(b) by 27 days.

(21) Appl. No.: 17/057,148

(22) PCT Filed: May 6, 2019

(86) PCT No.: PCT/EP2019/061552
§ 371 (c)(1),
(2) Date: Nov. 20, 2020

(87) PCT Pub. No.: WO2019/223988
PCT Pub. Date: Nov. 28, 2019

(65) Prior Publication Data

US 2021/0199126 A1 Jul. 1, 2021

(30) Foreign Application Priority Data

May 22, 2018 (EP) ..... 18173575

(51) Int. Cl.
*F04D 29/42* (2006.01)
*F04D 17/12* (2006.01)
(Continued)

(52) U.S. Cl.
CPC ..... *F04D 29/4253* (2013.01); *F04D 17/122* (2013.01); *F04D 25/0606* (2013.01); *F04D 29/441* (2013.01)

(58) Field of Classification Search
CPC ..... F04D 29/4253; F04D 29/441; F04D 25/0606; F04D 17/165
See application file for complete search history.

(56) References Cited

U.S. PATENT DOCUMENTS 8,662,822 B2 3/2014 Dittmar et al.
8,974,178 B2 * 3/2015 Stoicescu ..... F04D 29/426 415/204

(Continued)

FOREIGN PATENT DOCUMENTS

CN 102410049 A 4/2012
CN 102788022 A 11/2012

(Continued)

*Primary Examiner* — Sabbir Hasan
(74) *Attorney, Agent, or Firm* — The Webb Law Firm

(57) ABSTRACT

A radial turbomachine has a first housing part and a second housing part, which jointly form and delimit a flow channel. The first housing part forms a motor chamber for accommodating a drive motor, and the second housing part forms a gas inlet. Furthermore, a radial impeller is provided, which can be driven about an axis of rotation by the drive motor in order to suction a gas from outside the turbomachine through the gas inlet into the flow channel and to convey said gas out of the flow channel through a gas outlet to the outside. The first housing part or the second housing part forms the gas outlet at a radial distance from the axis of rotation and peripherally delimits the gas outlet.

15 Claims, 7 Drawing Sheets

(51) Int. Cl.
*F04D 25/06* (2006.01)
*F04D 29/44* (2006.01)

(56) References Cited

U.S. PATENT DOCUMENTS

| | | | | |
|---|---|---|---|---|
| 9,017,893 | B2 * | 4/2015 | DeWald | H01M 8/12 429/455 |
| 2008/0232962 | A1 | 9/2008 | Agrawal et al. | |
| 2010/0158679 | A1 | 6/2010 | Aust et al. | |
| 2011/0135519 | A1 * | 6/2011 | Cho | F04D 17/10 417/423.7 |
| 2012/0070274 | A1 | 3/2012 | Ferrazzi | |
| 2013/0183148 | A1 | 7/2013 | Stoicescu et al. | |
| 2013/0236303 | A1 | 9/2013 | Teramoto et al. | |
| 2016/0123346 | A1 | 5/2016 | Isogai et al. | |
| 2019/0242388 | A1 | 8/2019 | Krines et al. | |

FOREIGN PATENT DOCUMENTS

| | | | | |
|---|---|---|---|---|
| CN | 103206411 | A | | 7/2013 |
| DE | 102007053016 | A1 | | 5/2009 |
| DE | 102016210464 | A1 | | 12/2017 |
| DE | 102016210948 | A1 | | 12/2017 |
| EP | 0385298 | A2 | | 9/1990 |
| EP | 0492770 | A1 | | 9/1991 |
| EP | 1746290 | A1 | | 1/2007 |
| JP | 07259798 | A | * | 10/1995 |
| JP | H7259798 | A | | 10/1995 |
| JP | 2016084790 | A | | 5/2016 |
| WO | 02070139 | A2 | | 9/2002 |
| WO | 2011062633 | A1 | | 5/2011 |

* cited by examiner

RADIAL TURBOMACHINE

CROSS-REFERENCE TO RELATED APPLICATIONS

This application is the United States national phase of International Application No. PCT/EP2019/061552 filed May 6, 2019, and claims priority to European Patent Application No. 18173575.4 filed May 22, 2018, the disclosures of which are hereby incorporated by reference in their entirety.

BACKGROUND OF THE INVENTION

Field of the Invention

The present invention relates to a radial turbomachine for suctioning and conveying a gas, in particular air. The turbomachine may serve, for example, for generating an air flow, for suctioning air and/or for generating an overpressure and/or a negative pressure of air or a different gas.

Brief Description of the Related Art

Turbomachines, also including in particular fans and compressors, have been known for many years and are used in very different applications. The relevant turbomachines within the scope of this protective right have a generally electrically driven impeller which rotates in a housing. As a result, a gas, such as in particular air, is suctioned, conveyed and compressed. Fans are often also denoted as ventilators or blowers.

A specific class of turbomachines relates to radial turbomachines, in which the gas and the air, respectively, is generally suctioned axially and/or parallel to the axis of rotation of the impeller. The gas flow and air flow, respectively, is deflected by the rotation of the impeller by 90° and conveyed outwardly in the radial direction so as then to be blown out through a gas outlet. In comparison with other turbomachines, radial turbomachines generally permit the generation of a relatively high pressure for a predetermined quantity of air.

In addition to fulfilling the aerodynamic values required according to the application, in radial turbomachines in particular the robustness and a construction which is as compact and simple as possible are desirable. Moreover, the ventilator volume, the overall weight, the vibration behavior and the resulting acoustics may play an important role. Also important in the design of electrically driven turbomachines is a sufficient cooling of the electric motor.

For example, EP 1 746 290 A1 discloses a two-stage radial compressor in which an extraneous ventilator is used for cooling the motor.

A fan is disclosed in EP 0 492 770 A1 in which air is suctioned through the motor housing and is then conveyed radially outwardly by an impeller in order to be ultimately blown out centrally on the side of the impeller remote from the motor. The air flow in this case is subjected to repeated and significant deflections which impair the efficiency of the fan.

EP 0 385 298 A2 discloses a fan in which the air flow is axially suctioned, then conveyed radially outwardly, deflected on the periphery of an impeller by almost 180° and then blown out through the motor chamber. Also in this case, therefore, the air flow is subjected to significant deflections. The fan disclosed in this document additionally has a large number of housing parts which are connected together, resulting in a plurality of potentially unsealed points.

US 2013/0236303 A1 discloses a fan in which a first housing part which forms the motor chamber, together with a second housing part which has the air inlet opening forms a flow channel into which the suctioned air is conveyed by an impeller so as then to be blown out.

Furthermore, the documents DE 10 2007 053 016 A1 and DE 10 2016 210 464 A1 disclose turbomachines in which the turbomachine is in each case a side-channel compressor, instead of being radial turbomachines.

SUMMARY OF THE INVENTION

It is therefore an object of the present invention to provide an efficient radial turbomachine which has a compact construction with few parts.

In order to achieve this object, the present invention provides a radial turbomachine, in particular a radial fan, comprising

- a first housing part which forms a motor chamber for accommodating a drive motor;
- a second housing part which forms a gas inlet;
- a flow channel which is jointly formed and delimited by the first housing part and the second housing part;
- a gas outlet; and
- a radial impeller which can be driven about an axis of rotation by the drive motor in order to suction a gas, in particular air, from outside the turbomachine through the gas inlet into the flow channel and to convey said gas out of the flow channel through the gas outlet to the outside.

In this case the first housing part or the second housing part forms the gas outlet at a radial distance from the axis of rotation and circumferentially delimits the gas outlet.

Since the first or the second housing part forms the gas outlet and circumferentially delimits the gas outlet, it is ensured in a particularly simple manner that no leakages are able to occur in the region of the gas outlet. By the radial distance of the gas outlet from the axis of rotation of the radial impeller additionally deflections of the gas flow between the gas inlet and the gas outlet may be reduced to a minimum, whereby the efficiency of the turbomachine is improved.

Preferably, the first housing part forms the gas outlet and circumferentially delimits this gas outlet. The gas may then be conveyed out of the gas outlet, in particular in the same direction or at least approximately in the same direction as that in which it is suctioned through the gas inlet. Preferably, the gas outlet is formed in particular by a gas outlet opening which is circumferentially delimited by the material of the first housing part.

The radial turbomachine is preferably a radial fan. However, for example, it may also be a radial compressor. In the radial turbomachine the gas inlet is generally arranged in the vicinity of the axis of rotation and the gas outlet is arranged at a distance from the axis of rotation, so that the gas is conveyed between the gas inlet and the gas outlet in the radial direction to the outside.

The first housing part forms the motor chamber and, therefore, may also be denoted as the motor housing. The motor chamber is preferably formed by a bag-like recess into which the drive motor may be advantageously introduced from the opening side along the axis of rotation. In the region of the opening side, the first housing part preferably transitions in the radial direction, i.e. perpendicular to the axis of rotation, into a protruding region. On its side remote from the motor chamber, the protruding region preferably forms the flow channel which is advantageously configured there in the form of a recess. The gas outlet is preferably configured, for example, in the form of an outlet pipe, on the side of the protruding region facing the motor chamber. The flow channel which is configured on the remote side, therefore, transitions via a through-opening into the gas outlet on the side of the protruding region facing the motor chamber. The outlet pipe may have an internal or external thread for connecting to a coupling element or a hose connector, for example, or the outlet pipe may be of smooth configuration or have circumferential ribs for the sealed positioning of a flexible hose on its outer face, for example.

Preferably, cooling ribs are present on the outer face of the first housing part, in particular on the outer face of the motor chamber, for the passive dissipation of heat energy from the motor chamber.

The drive motor is preferably an electric motor. In this case advantageously the rotor is arranged internally and the stator is arranged externally. The rotor is thus preferably connected fixedly in terms of rotation via a drive shaft to the radial impeller.

The gas may, in particular, be air. In principle, however, any other gaseous medium may be suctioned and conveyed by the radial impeller.

The second housing part forms the gas inlet which, in particular, is formed by a gas inlet opening, which is preferably delimited over the circumference by the material of the second housing part. The gas inlet is preferably arranged concentrically to the axis of rotation. Advantageously the gas inlet is formed by an inlet pipe which protrudes outwardly on the side of the second housing part remote from the first housing part. The inlet pipe may have an internal or external thread for connecting to a coupling element or a hose connector, for example, or the inlet pipe may be of smooth configuration or have circumferential ribs for the sealed positioning of a flexible hose on its outer face, for example. Preferably, the side of the second housing part facing towards the first housing part forms the flow channel which is advantageously configured therein in the form of a recess. Via a through-opening, therefore, the gas inlet transitions into the flow channel configured on the other side of the second housing part.

The flow channel is formed jointly by the first and the second housing part and is delimited thereby. The flow channel in this case connects, in particular, the gas inlet to the gas outlet. Preferably, the flow channel has an inner radial region and a peripheral region. In the radial region the direction of movement of the gas has a radial component so that the gas is conveyed radially to the outside. In the peripheral region, however, the movement component of the gas in the peripheral direction and/or in the tangential direction clearly predominates.

The radial region preferably extends radially circumferentially to the gas inlet from the axis of rotation to the outside and is also advantageously conically configured, with an opening angle oriented along the axis of rotation toward the first housing part. The radial region of the flow channel preferably serves for accommodating the radial impeller. The radial impeller is therefore preferably arranged in the flow channel, i.e. in particular between the first and the second housing part. On its radial outer face the radial region advantageously transitions into the peripheral region of the flow channel.

The peripheral region generally extends circumferentially around the radial region and, in particular, around the radial impeller and serves to transfer the gas into a circulating annular or spiral flow. Preferably, the first and the second housing part form the peripheral region of the flow channel, in each case approximately half thereof. The peripheral region in this case runs preferably substantially along its entire extent in the circumferential direction inside the same plane. Preferably in the circumferential direction the cross-sectional surface of the flow channel is enlarged in the radial region toward the gas outlet, in particular continuously. As a result, the changing pressure conditions in the circumferential direction are taken into consideration. The enlargement in the cross-sectional surface, for example, may be achieved by means of an increasing external radius of the radial region and/or by means of a continuous widening of the flow channel in the direction of the axis of rotation.

Preferably, the turbomachine has at least one radial region and/or at least one peripheral region which is formed and delimited jointly by the first housing part and the second housing part. The flow channel has, therefore, advantageously at least one portion in which it is formed and delimited in cross section jointly by the first and the second housing part.

The radial impeller is configured to be set into rotational movement by the drive motor about the axis of rotation, in order to suction the gas through the gas inlet and to convey the gas radially to the outside. During the conveyance of the gas radially to the outside, due to the rotational movement of the radial impeller the gas is additionally subjected to a movement component facing in the circumferential direction, whereby when the gas reaches the peripheral region of the flow channel advantageously it already principally moves in the circumferential direction toward the gas outlet.

The connection of the flow channel to the gas outlet preferably takes place relative to the axis of rotation in the tangential, rectilinear direction. Advantageously the transition of the peripheral region of the flow channel into the gas outlet is continuous. In this manner, deflections of the gas flow and turbulence between the flow channel and the gas outlet are minimized. The gas outlet, therefore, is preferably arranged radially outside the flow channel.

Advantageously, the first housing part and further advantageously also the second housing part are in each case produced as a whole in one piece and preferably as a cast element. In each case, the cast element may be produced, in particular, from aluminum or zinc. By their respective configuration in one piece, the first and the second housing part are not only able to be produced in a particularly simple manner but the number of potentially unsealed points is reduced to a minimum. Advantageously, the radial turbomachine has a tightness according to IP 67 to IEC Standard 60529. When producing the first and second housing part in each case as a cast element, a particularly robust turbomachine is also achieved. The one-piece configuration of the first housing part, in particular when produced from a metal, additionally leads to an optimal transfer of motor heat to the surfaces of the first housing part delimiting the flow channel and thus to an efficient dissipation of the heat by the gas flow in the flow channel. In further embodiments which are also preferred, however, the first housing part and/or the second housing part may also be configured in multiple parts. Advantageously, however, at least the first housing part or the second housing part is configured in one piece.

The gas inlet is preferably an axial gas inlet through which the gas is suctioned in a direction into the flow channel which extends parallel to the axis of rotation of the radial impeller.

The gas outlet is preferably an axial gas outlet through which the gas is conveyed outwardly in a direction which extends parallel to the axis of rotation of the radial impeller. An axial gas outlet permits a particularly space-saving use of the turbomachine. In particular, it is also possible thereby to arrange a plurality of such radial turbomachines connected in series one behind the other in a space-saving manner.

In order to deflect the gas flowing out of the flow channel in the direction of the gas outlet, the second housing part preferably has a deflection element which, in particular and preferably, may constitute a one-piece element configured on the second housing part. The deflection element serves, in particular, for deflecting the gas flowing out of the flow channel in the direction in which it is conveyed outwardly from the turbomachine through the gas outlet. To this end the deflection element advantageously has a continuously curved surface which serves for deflecting the gas flow. Preferably, the deflection element is configured to effect a deflection of the flowing gas by ca. 90°.

According to a development of the invention, the deflection element at least partially protrudes into the gas outlet, in particular into the region of the gas outlet circumferentially delimited by the first housing part. In this manner, an optimal transition is achieved, i.e. as far as possible without turbulence, for the gas flow from the flow channel to the gas outlet.

A particularly robust and compact design of the turbomachine may be achieved when the first housing part and the second housing part are configured in each case in a substantially plate-shaped manner on the outer face in the region of the flow channel. The flow channel is thus configured on the inner faces, i.e. on the sides facing one another of the first and second housing part, preferably in each case in the form of a recess. A plate-shaped outer face of the first and second housing part in the region of the flow channel, however, has further advantages. Thus, for example, drilling holes and screw holes may be easily provided in order to connect the two housing parts together and/or to further components, or labels, etc. may be easily applied to the outer face.

Advantageously a sealing element is present between the first housing part and the second housing part in order to circumferentially seal the flow channel to the outside. The sealing element may be configured, in particular, as an O-ring and may be introduced into a groove correspondingly provided therefor on the first or second housing part. Preferably, the sealing element is additionally circumferentially arranged around the gas inlet.

Moreover, preferably the sealing element is additionally circumferentially arranged around the gas outlet. In this manner, an optimal sealing of the flow channel and, in particular, also of the gas outlet may be achieved. A space is preferably present, therefore, between the first and the second housing part, said space being fully sealed to the outside, except for the gas inlet and the gas outlet, and containing at least the flow channel, preferably at least the flow channel and the motor chamber. The outwardly sealed space preferably has an overall tightness which is designed according to IP 67 to IEC Standard 60529.

The first housing part and preferably also the second housing part are advantageously produced from a metal. The turbomachine becomes particularly robust thereby. Moreover, when produced from metal, heat which is generated in the motor chamber may be particularly easily dissipated to the outside.

Advantageously, the entire housing of the radial turbomachine is substantially exclusively formed by the first and the second housing part. In particular, in the region of the gas inlet, the flow channel and the gas outlet, the housing of the turbomachine is advantageously exclusively formed by the first and the second housing part. By "substantially exclusively" it is understood that the entire housing may have further components which are barely relevant in terms of their function relative to defining the gas flow and the motor chamber, such as for example a cover for closing a compartment for accommodating an electronics unit. If a compartment for accommodating an electronics unit is present, preferably this constitutes a part of the chamber which is fully sealed to the outside, except for the gas inlet and the gas outlet. A sealing element which is configured, in particular, as an O-ring is thus preferably present between the first housing part and the cover. Advantageously, a connecting plug which leads outwardly from the motor chamber or the compartment with the electronics unit is also sealingly connected to the first housing part and/or the cover.

In order to permit a series connection to further such radial turbomachines one behind the other, according to a development of the invention the turbomachine may additionally have a coupling piece in order to connect the gas outlet to the gas inlet of a further radial turbomachine.

The radial turbomachine according to the invention is suitable, in particular, for industrial applications such as transport ("pick and place"), cleaning, air drying, etc. Applications are also found, in particular, in the paper industry.

BRIEF DESCRIPTION OF THE DRAWINGS

Preferred embodiments of the invention are described hereinafter with reference to the drawings which are merely explanatory and are not to be interpreted as limiting. In the drawings.

DESCRIPTION OF PREFERRED EMBODIMENTS

Figure 1:
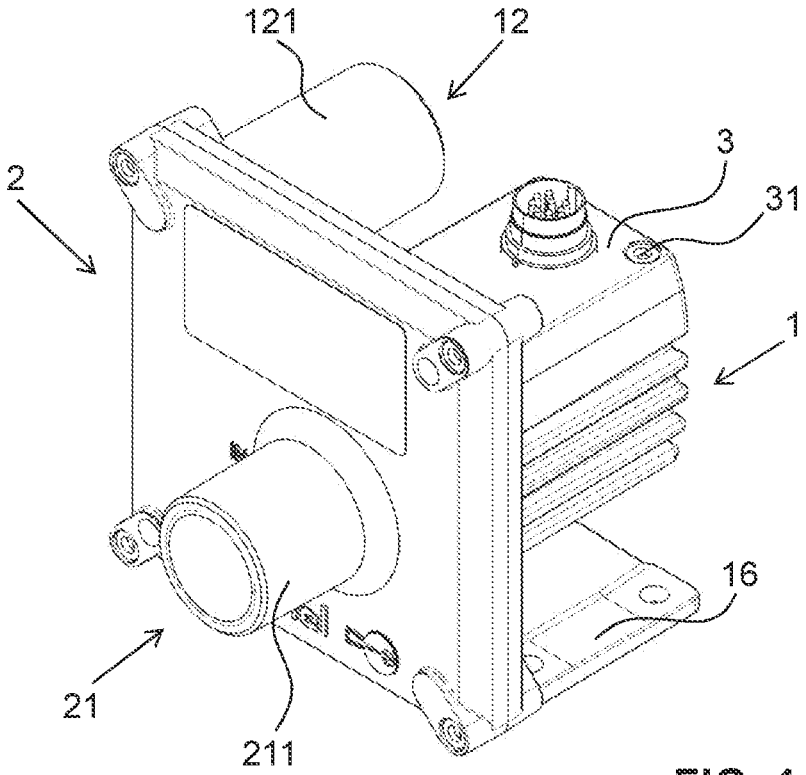
FIG. 1 shows a perspective view of a preferred embodiment of a radial turbomachine according to the invention.

FIGS. 1 to 13 show preferred embodiments according to the invention of a radial turbomachine in different views. Elements which have identical or similar functions are provided in each case with the same reference numerals.

As is visible in FIG. 1, the radial turbomachine according to the embodiment shown has an exceptionally compact and robust construction overall. This is based, in particular, on the simple configuration of the housing consisting of substantially only two housing parts 1 and 2 and on the plate-shaped design of the two housing parts 1 and 2 in the region where they bear against one another and where the gas passes through the turbomachine.

Both the first housing part 1 and the second housing part 2 are produced as a whole in one piece as a cast element from metal.

Figure 2:
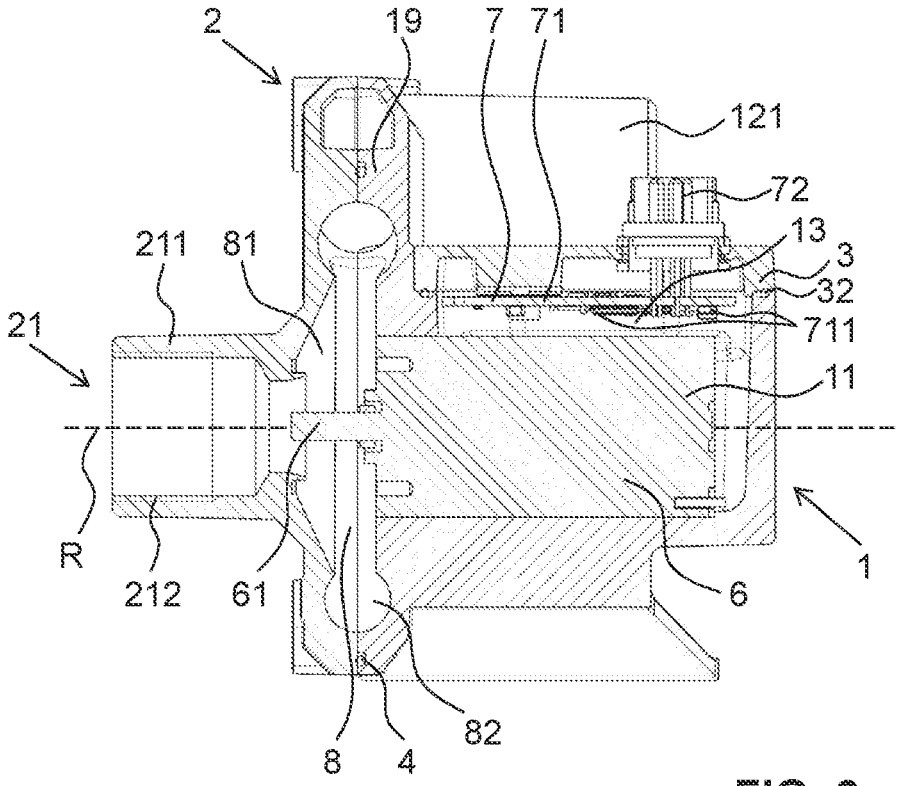
FIG. 2 shows a central cross-sectional view of the radial turbomachine of FIG. 1 along the axis of rotation, wherein the radial impeller is omitted for illustrative reasons.
Figure 3:
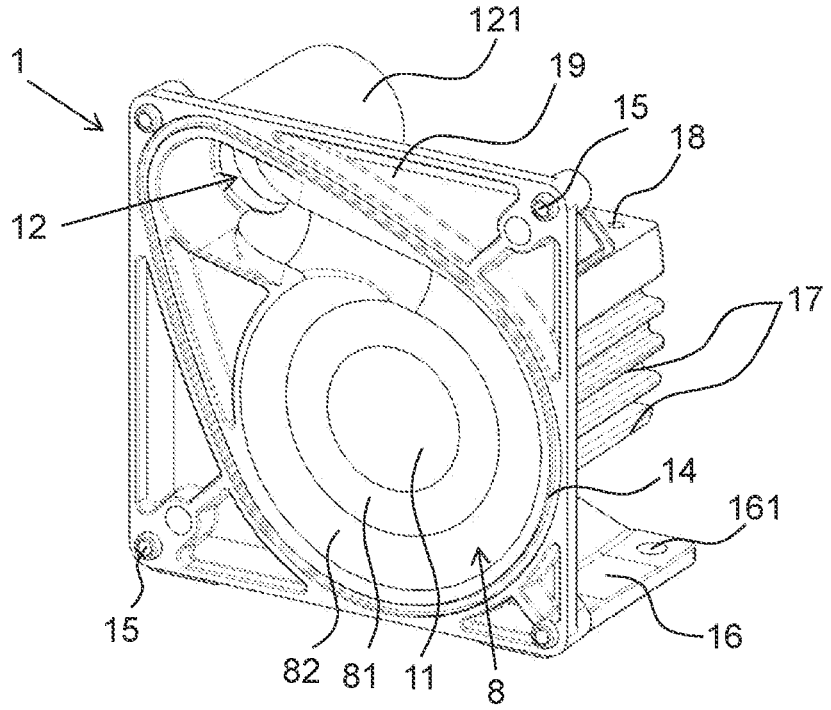
FIG. 3 shows a first perspective view of the inner face of the first housing part of the radial turbomachine of FIG. 1.
Figure 4:
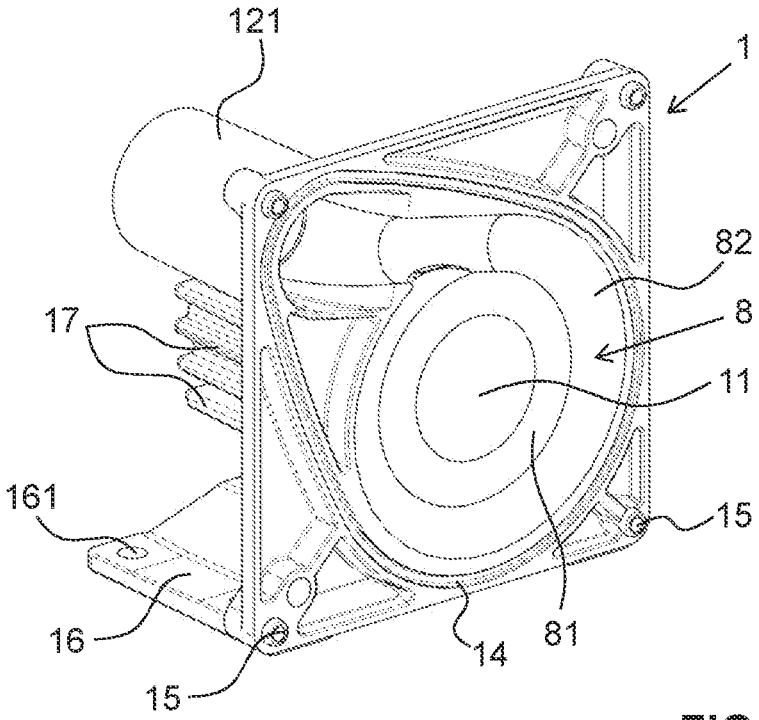
FIG. 4 shows a second perspective view of the inner face of the first housing part of the radial turbomachine of FIG. 1.
Figure 5:
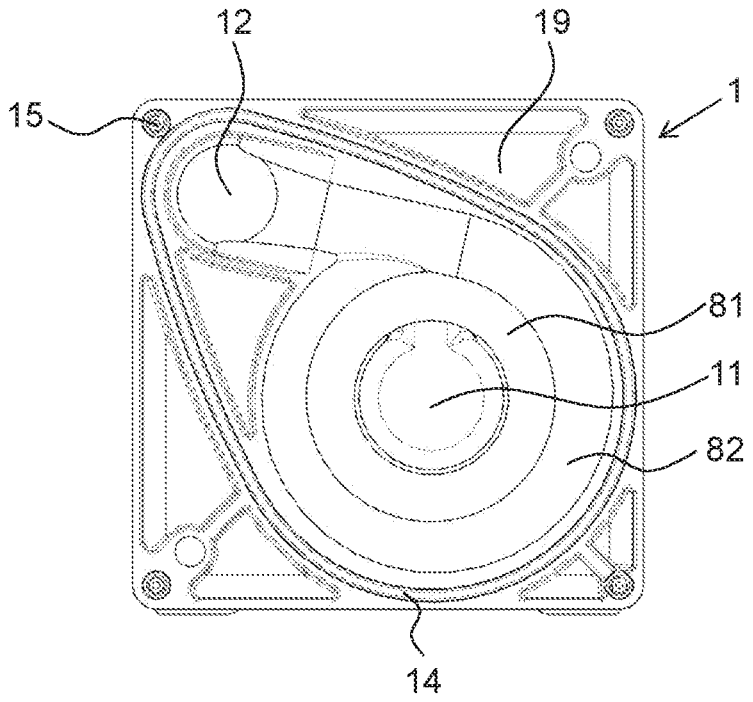
FIG. 5 shows a plan view of the inner face of the first housing part of the radial turbomachine of FIG. 1.

The first housing part 1 is shown in FIGS. 3 to 5 and, as in particular may be easily identified in FIG. 2, forms a motor chamber 11 in which a drive motor 6 is accommodated. Since the motor chamber 11 is configured as a bag-like recess in the housing part 1 and is configured to be open toward the second housing part 2, the drive motor 6 may be easily inserted into the motor chamber 11 when the second housing part 2 is removed. Otherwise, the motor chamber 11, with the exception of the upper face closed by a cover 3, is circumferentially enclosed by the first housing part 1. By this enclosure of the motor chamber 11 by the first housing part 1 an optimal dissipation of heat from the motor chamber 11 is possible.

Figure 9:
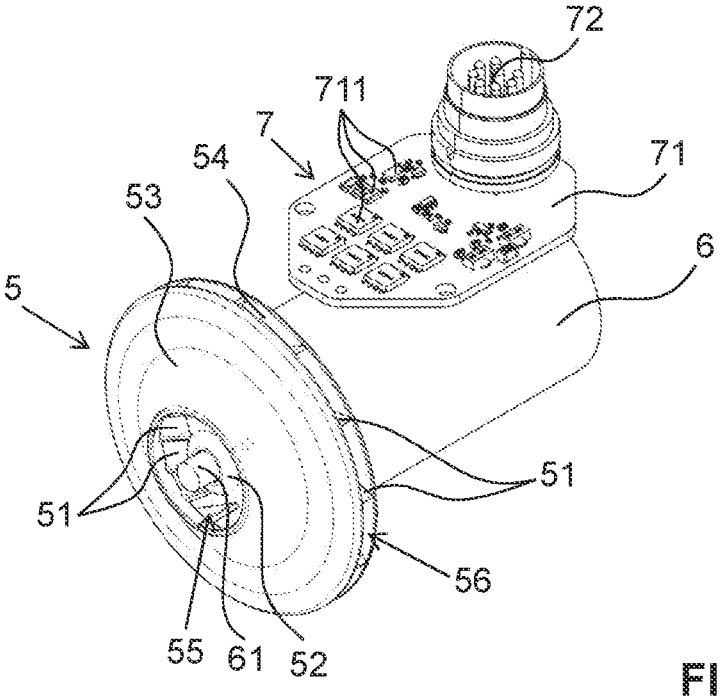
FIG. 9 shows a perspective view of the radial impeller, the drive motor and the electronics unit of the radial turbomachine of FIG. 1.

The drive motor 6 is preferably an AC electric motor, in which the rotor is advantageously arranged internally and the stator is advantageously arranged externally. Advantageously the drive motor 6 is designed for rotational speeds of up to 40,000 RPM. The drive motor 6 serves for driving a drive shaft 61 and thereby for driving a radial impeller 5 which is attached fixedly in terms of rotation to the front end of the drive shaft 61 (FIG. 9). The rotational movement carried out by the radial impeller 5 during operation of the radial turbomachine defines an axis of rotation R (FIG. 2).

Above the drive motor 6 the first housing part 1 is configured to be open per se, but closed by the aforementioned cover 3. The cover 3 is also produced as a whole in one piece and as a cast element from metal. For the releasable fastening of the cover 3 to the first housing part 1 screws are screwed through screw holes 31 of the cover 3 into threaded bores 18 correspondingly provided on the first housing part 1 (see FIG. 3). By means of these screw connections and the direct bearing of the cover 3 against the first housing part 1 an effective dissipation of heat from the motor chamber 11 is also possible via the cover 3.

A compartment 13 which serves for accommodating an electronics unit 7 is provided below the cover 3, i.e. between the cover 3 and the drive motor 6. The electronics unit 7 serves, in particular, for controlling and supplying energy to the drive motor 6 and has a printed circuit board 71 with electronic components 711 attached to the upper and lower face. Additionally a plug connector 72, which protrudes outwardly through a through-opening provided correspondingly in the cover 3, is attached to the printed circuit board 71. The plug connector 72 serves for connecting an external control and energy supply unit, not shown in the figures. By screwing off the cover 3 from the first housing part 1, the electronics unit 7 is easily accessible and if required easily repairable or replaceable. A sealing element, for example an O-ring, may be provided between the cover 3 and the first housing part 1, said sealing element, for example, being inserted in a groove provided on the first housing part 1 in order to seal the compartment 13 and the motor chamber 11 to the outside.

The first housing part 1 circumferentially around the compartment 13 has a sealing groove into which a sealing element 32, which in particular may be configured as an O-ring, is inserted. The sealing element 32 serves for sealing the first housing part 1 relative to the cover 3 in the region of the compartment 13. Advantageously a further sealing element, which is not shown in the figures, however, and which is preferably configured as an O-ring, is arranged between the plug connector 72 and the cover 3 in order to provide a seal of the compartment 13 on the circumference of the plug connector 72 toward the outside.

As is visible for example in FIG. 3, the first housing part 1 in its region enclosing the motor chamber 11 has cooling ribs 17 on the outer face, which serve for dissipating heat energy from the motor chamber 11.

In the region of the front end of the motor chamber 11, i.e. facing toward the second housing part 2, the first housing part 1 transitions perpendicularly, i.e. relative to the axis of rotation R radially outwardly, into a circumferential protruding region 19. The first housing part 1 is configured in this protruding region 19 to be substantially plate-shaped at least on its side facing to the rear, i.e. in the direction of the motor chamber 11. The protruding region 19 has an approximately square shape overall.

Below the region which encloses the motor chamber 11, a base 16 of the first housing part 1 extends from the protruding region 19 to the rear. The base 16 which is connected at the top to the region of the first housing part 1 enclosing the motor chamber 11 has screw holes 161 for fastening the radial turbomachine to a further component or to a support element.

On the front face which faces the second housing part 2, the first housing part 1 in the region of the projection 19 has a recess which together with a recess of the second housing part 2, described further below, forms a flow channel 8. The flow channel 8 is arranged concentrically circumferentially relative to the axis of rotation R and has an inner radial region 81 which transitions radially outwardly into a circumferential outer peripheral region 82. In the radial region 81 the first housing part 1 is slightly recessed but of planar configuration. In the peripheral region 82 the first housing part 1 is configured to be recessed over the circumference in an annular manner, wherein the recess of the radial region 81 in the radial direction over the circumference transitions into the annular recess of the peripheral region 82. The peripheral region 82 of the flow channel 8 is in this case delimited in the cross-sectional view according to FIG. 2 by rounded delimiting surfaces of the first housing part 1.

The peripheral region 82 of the flow channel 8 widens continuously relative to its cross-sectional surface in the peripheral direction, as may be clearly identified for example in FIG. 5. In the region shown at the top in FIG. 5, the recess which is configured in the first housing part 1 and which forms the peripheral region 82 of the flow channel 8 transitions tangentially and with a further widening cross-sectional surface into a gas outlet 12. The gas outlet 12 is formed by a gas outlet pipe 121 which extends to the rear on the rear face of the first housing part 1 parallel to the axis of rotation R. The gas outlet pipe 121 which is formed entirely by the first housing part 1 delimits a gas outlet opening through which the gas flowing out of the flow channel 8 may be blown out of the radial turbomachine. On its inner face the gas outlet pipe 121 has an internal thread for connecting, for example, an air line or a coupling element.

In order to permit a transition which is continuous, and thus as far as possible without turbulence, from the flow channel 8 to the gas outlet pipe 121, the recess which forms on the front face of the first housing part 1 the peripheral region 82 of the flow channel 8 transitions continuously via a rounded surface into the gas outlet pipe 121. In other words, the recess is increasingly recessed toward the gas outlet 12. Therefore, a continuous opening is configured in the region of the gas outlet 12 in the first housing part 1. The gas outlet pipe 121 extends parallel to the axis of rotation R out of the protruding region 19 to the rear.

Over the circumference around the recess forming the flow channel 8, the first housing part 1 has a sealing groove 14 into which a sealing element 4 in the form of an O-ring is introduced. The sealing groove 14 and thus the sealing element 4 are not only arranged over the circumference around the flow channel 8 but also around the gas outlet 12 and/or around the through-opening formed by the gas outlet 12. The sealing element 4 serves for sealing the first housing part 1 relative to the second housing part 2 in the region of the flow channel 8.

In each case, threaded bores 15 which serve for fastening the second housing part 2 to the first housing part 1 are provided in the corners of the protruding region 19 of the first housing part 1.

Figure 6:
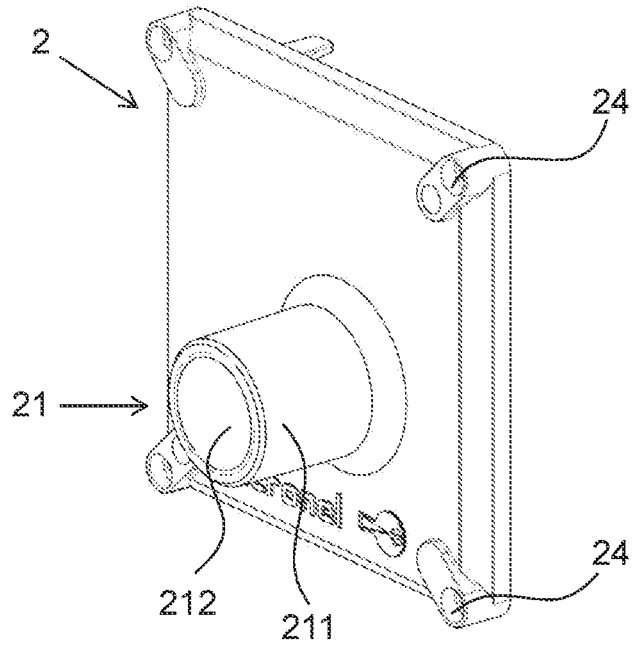
FIG. 6 shows a perspective view of the outer face of the second housing part of the radial turbomachine of FIG. 1.
Figure 7:
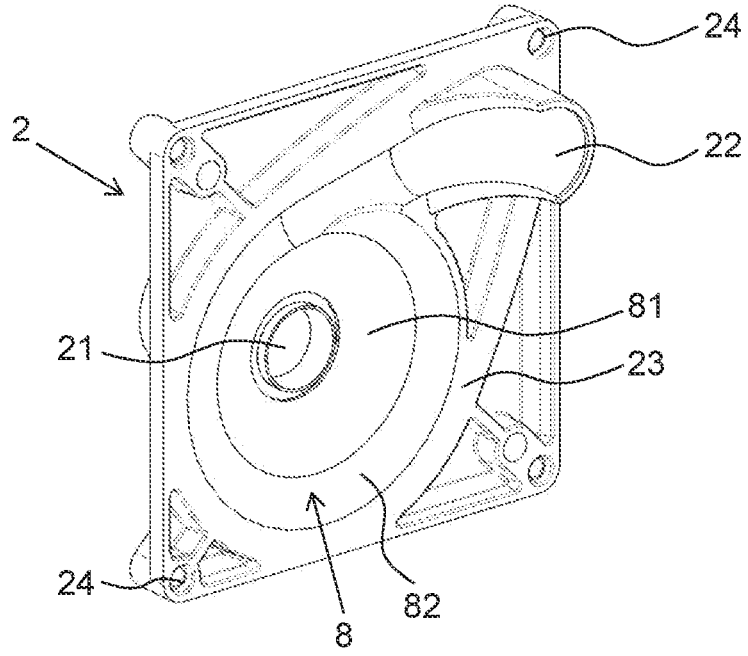
FIG. 7 shows a perspective view of the inner face of the second housing part of the radial turbomachine of FIG. 1.
Figure 8:
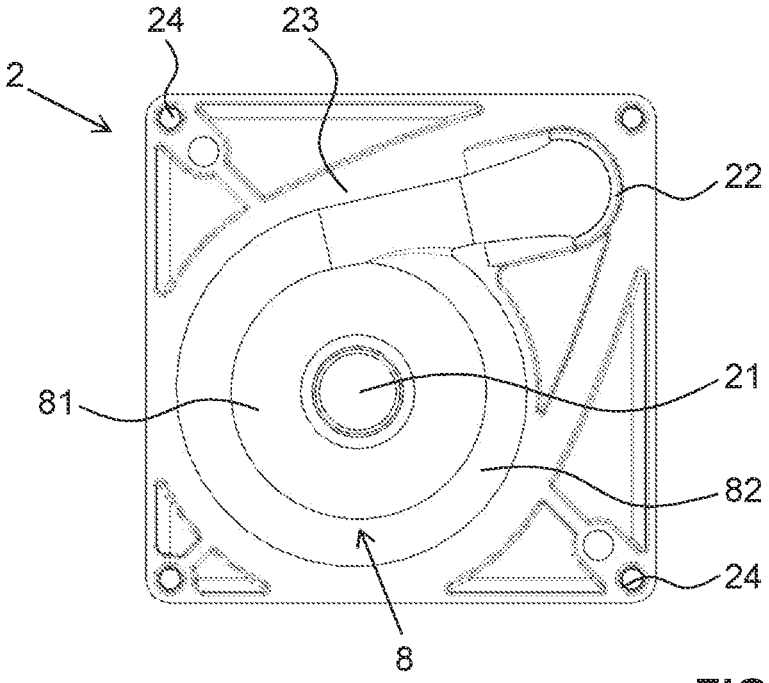
FIG. 8 shows a plan view of the inner face of the second housing part of the radial turbomachine of FIG. 1.

The second housing part 2 is shown, in particular, in FIGS. 6 to 8. As may be identified in FIG. 6, the second housing part 2 has overall a substantially plate-shaped outer shape, with the exception of a gas inlet pipe 211 protruding on the front face and a deflection element 22 protruding on the rear face. The second housing part 2 in this case describes a substantially square shape, corresponding to the shape of the projection 19 of the first housing part.

The gas inlet pipe 211 is arranged concentrically to the axis of rotation R and extends outwardly parallel thereto from the front face, which is otherwise of substantially planar configuration, of the second housing part 2. A gas inlet opening extends continuously through the gas inlet pipe 211 and the second housing part 2 and thus forms a gas inlet 21. On its inner face the gas inlet pipe 211 has an internal thread 212 for connecting, for example, an air line or a coupling element.

On the rear and inner face of the second housing part 2, respectively, which may be identified in FIGS. 7 and 8, a recess is configured concentrically and circumferentially to the gas inlet 21, said recess jointly forming and delimiting the flow channel 8 with the recess described further above of the first housing part 1. Similar to the recess of the first housing part 1, that of the second housing part 2 also has an inner region which delimits the radial region 81 of the flow channel 8 as well as an outer region which delimits the peripheral region 82 of the flow channel 8.

The inner region of the recess of the second housing part 2 which forms the radial region 82 of the flow channel 8 has a conically configured front delimiting surface with an opening angle oriented toward the first housing part 1 along the axis of rotation R. The conical delimiting surface, which in particular is clearly identifiable in FIG. 2, corresponds to the similarly conically configured front face of the radial impeller 5.

In the radial direction an annular recess which forms the peripheral region 82 of the flow channel 8 circumferentially adjoins the conical delimiting surface. Similar to the annular recess of the first housing part 1, the annular recess of the second housing part 2 also continuously widens in the circumferential direction and has a rounded delimiting surface.

In the region shown at the top in FIG. 8, the recess which forms the peripheral region 82 of the flow channel 8 is guided further in the tangential rectilinear direction to a deflection element 22. When the first and the second housing part are connected together as intended, the deflection element 22 protrudes into the gas outlet 12 and, in particular, the gas outlet pipe 121 of the first housing part 1. The deflection element serves to deflect the gas flowing out of the flow channel 8, as far as possible without turbulence, by ca. 90° and to conduct the gas into the gas outlet pipe 121. To this end, the deflection element 22 has a continuously rounded inner surface along which the gas flow is deflected by ca. 90° in a direction extending parallel to the axis of rotation R. Moreover, the deflection element 22 also has in the cross section of the gas flow a rounded delimiting surface which continuously transitions into the rounded delimiting surface which is configured by the recess of the second housing part 2, which forms the peripheral region 82 of the flow channel 8.

Around the recess which forms the flow channel 8 the second housing part 2 has a sealing surface 23 which is configured to be planar as a whole. The sealing surface 23 extends both circumferentially around the gas inlet 21 and around the deflection element 22. The sealing surface serves for the bearing of the sealing element 4 and thus as a sealing seat for sealing the flow channel 8 to the outside.

In each case, screw holes 24 through which screws are able to be screwed into the threaded bores 15 of the first housing part 1 are provided in the corners of the second housing part 2 in order to fasten the second housing part 2 to the first housing part 2.

The flow channel 8 is thus formed, on the one hand, by a recess which is configured on the side of the first housing part 1 facing toward the second housing part 2 and, on the other hand, by a recess corresponding thereto, which is configured on the side of the second housing part 2 facing toward the first housing part 1. In the peripheral region 82 the flow channel 8 has continuously an approximately circular cross-sectional surface. An approximately circular cross-sectional surface is also present in the extension of the flow channel 8 in the region of the deflection element 22 and in the gas outlet pipe 121. Due to this continuously circular cross-sectional surface, a gas guidance is achieved inside the turbomachine which is substantially without turbulence.

The radial impeller 5 which is shown in FIG. 9 is attached in the region of a hub 52 fixedly in terms of rotation to the drive shaft 61. In the region of the hub 52 and thus concentrically to the axis of rotation R a circular inlet opening which forms an air inlet region 55 is configured in a front wall 53 of the radial impeller 5. Impeller blades 51 arranged between the front wall 53 and a rear wall 54 in each case extend approximately radially outwardly and serve during operation to convey radially outwardly the gas flowing into the air inlet region 55. The gas leaves the radial impeller 5 in this case via an air outlet region 56 arranged radially on the outside.

Due to the conical configuration of the front wall 53 the space for the gas in the radial direction to the outside reduces between the front wall 53 and the rear wall 54. The gas is thus increasingly compressed when conveyed to the outside.

The radial impeller 5 is arranged in the radial region 81 of the flow channel 8, i.e. between the first housing part 1 and the second housing part 2.

Due to the sealing elements 4 and 32, the internal space which is delimited by the first housing part 1, the second housing part 2 and the cover 3, and which comprises the flow channel 8, the motor chamber 11 and the compartment 13, with the exception of the gas inlet 21 and the gas outlet 121, is fully sealed to the outside and preferably according to IP 67 to IEC standard 60529. During the operation of the turbomachine, therefore, preferably a pressure prevails in the motor chamber 11 and in the compartment 13 which is raised relative to the external pressure and which, in particular, may substantially correspond to the pressure in the flow channel 8.

During operation of the radial turbomachine, the radial impeller 5 is set in rotational movement about the axis of rotation R by the drive motor 6. As a result, by means of the impeller blades 51 a gas and/or air is suctioned through the gas inlet pipe 211 into the flow channel 8 and conveyed in the radial region 81 thereof radially to the outside. The impeller blades 51 move the gas at the same time in the circumferential direction, said gas thus passing along a spiral from the radial region 81 into the peripheral region 82 of the flow channel 8. Via the peripheral region 82 the compressed gas passes to the deflection element 22 where it is deflected by ca. 90° in a direction extending parallel to the axis of rotation R and is blown out through the gas outlet pipe 121.

Figure 10:
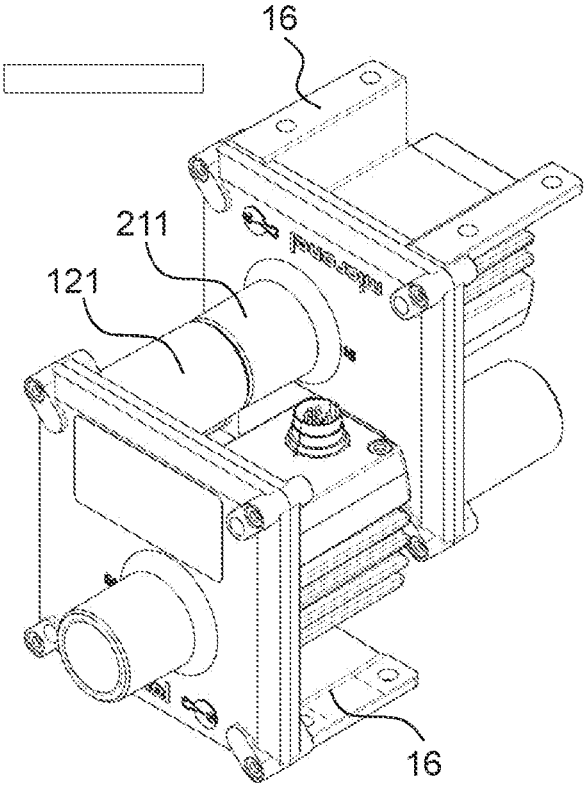
FIG. 10 shows a perspective view of two radial turbomachines which are arranged so as to be connected in series one behind the other and which in each case are configured according to the embodiment shown in FIG. 1.
Figure 11:
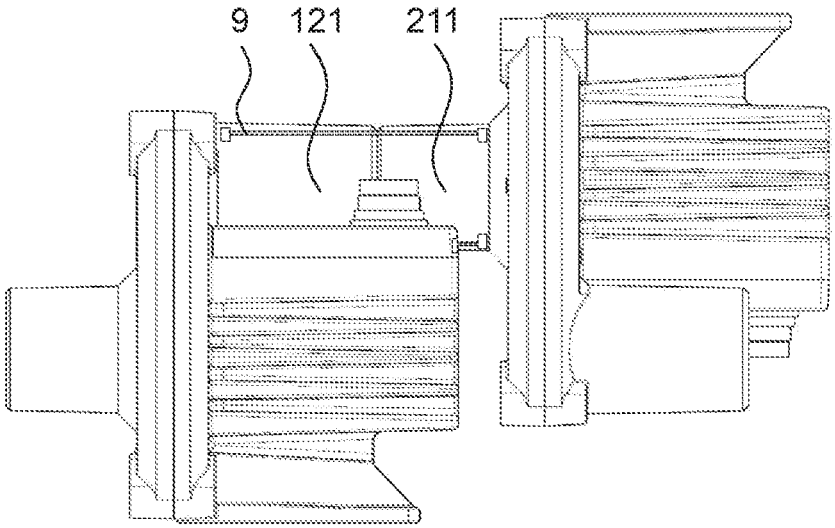
FIG. 11 shows a side view of the two radial turbomachines of FIG. 10 which are arranged so as to be connected in series one behind the other.

In order to increase further the pressure of the gas, a plurality of such radial turbomachines may be connected in series one behind the other. To this end, the gas outlet pipe 121 of a first radial turbomachine may be coupled to the gas inlet pipe 211 of a second radial turbomachine which is shown in FIGS. 10 and 11. The outlet pressure is doubled thereby or correspondingly multiplied when further such radial turbomachines are connected one behind the other.

For coupling the two radial turbomachines a coupling piece 9 may be used, said coupling piece being able to be screwed, on the one hand, into the internal thread of the gas outlet pipe 121 of the first radial turbomachine and, on the other hand, into the internal thread 212 of the gas inlet pipe 211 of the second radial turbomachine.

In the case of radial turbomachines which are arranged so as to be connected in series one behind the other, in order to achieve a relatively compact arrangement the two turbomachines may be mutually arranged so as to be rotated relative to one another by 180°, as shown in FIG. 10. The gas outlet 12 of the second radial turbomachine is thus exactly aligned with the gas inlet 21 of the first radial turbomachine.

Figure 12:
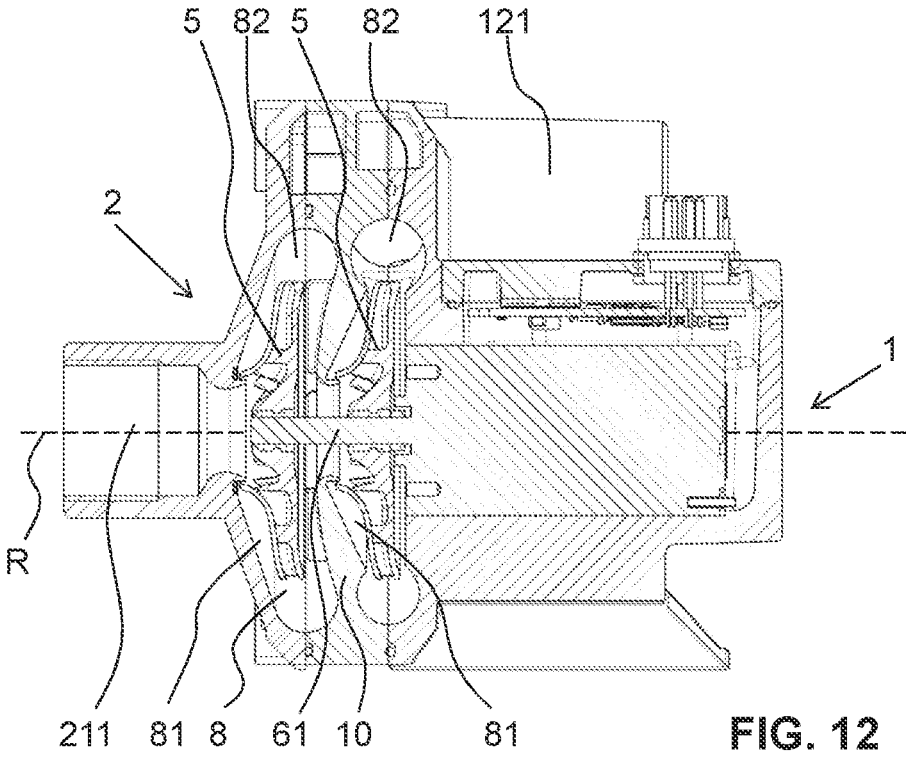
FIG. 12 shows a central cross-sectional view of a further preferred embodiment of a radial turbomachine according to the invention with two radial impellers.
Figure 13:
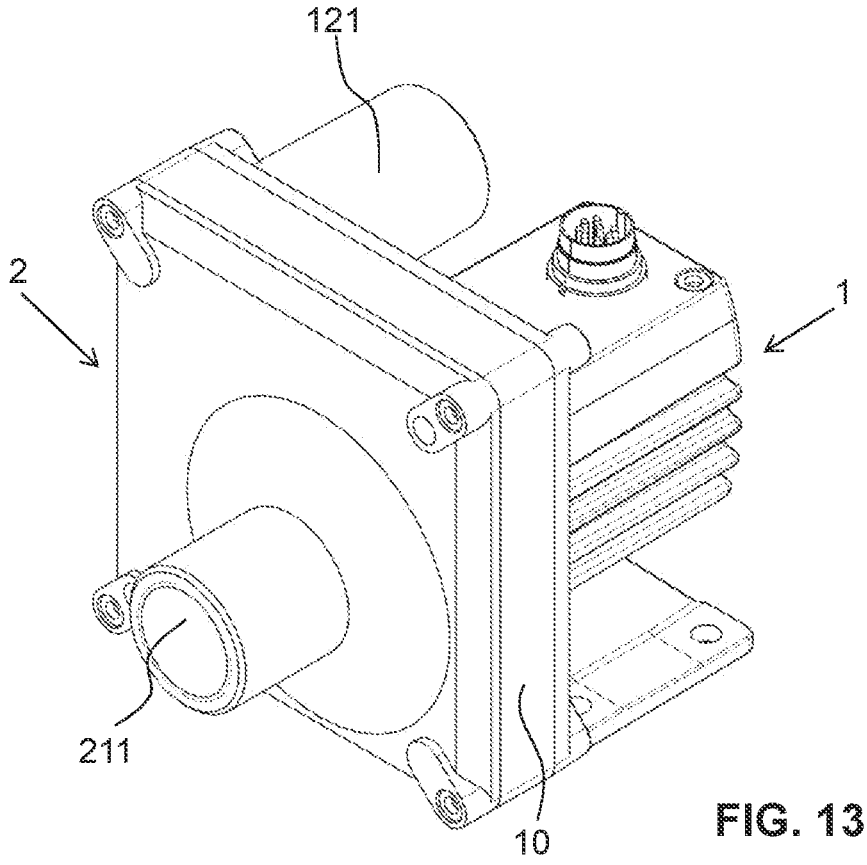
FIG. 13 shows a perspective view of the turbomachine of FIG. 12.

As a further possibility for increasing the gas pressure a plurality of stages, with one respective radial impeller 5, may be provided inside the radial turbomachine. A corresponding embodiment is shown in FIGS. 12 and 13. The two radial impellers 5 are both attached fixedly in terms of rotation to the drive shaft 61 and thus are drivable by the drive motor 6. An intermediate part 10 is arranged between the first housing part 1 and the second housing part 2 in the region between the two radial impellers 5. The intermediate part 10 delimits the flow channel 8 on both sides, i.e. on the one hand toward the first housing part 1 and on the other hand toward the second housing part 2. The gas flowing in through the gas inlet pipe 211 of the second housing part 2 thus initially passes into a first radial region 81 of the flow channel 8 in the region of the first radial impeller 5, which forms a first (high pressure) stage of the turbomachine. From this first radial impeller 5 the gas then is conveyed radially outwardly into a first peripheral region 82 and from there along the rear face of the first radial impeller 5 again in the direction of the axis of rotation R and axially through a through-opening arranged centrally in the intermediate part 10. From this through-opening the gas passes directly into a second radial region 81 of the flow channel 8 which is located in the region of the second radial impeller 5. The second radial impeller 5 forms a second (low pressure) stage of the turbomachine. From the second radial impeller 5 the gas is conveyed radially outwardly into a second peripheral region 82 of the flow channel 5 and finally outwardly through the gas outlet pipe 121. For an optimal adaptation to the respective pressure conditions, the first and the second radial impeller 5 and also the first and second radial region 81 and the first and second peripheral region 82 are designed and, in particular, dimensioned differently in each case.

The preferably one-piece intermediate part 10 which is produced, in particular, as a cast element thus forms a further housing part of the radial turbomachine. The central through-opening provided in the intermediate part 10 in this case forms a gas inlet for the second (low pressure) stage and/or a gas outlet for the first (high pressure) stage of the turbomachine. Depending on the perspective, the first housing part 1 together with the intermediate part 10 or the second housing part 2 together with the intermediate part 10 may also be regarded as a multipart housing part 1, 10 and/or 2, 10.

Naturally, the invention described herein is not limited to the aforementioned embodiments and a plurality of modifications is possible. Thus in principle the gas outlet may also be formed by the second housing part 2 and delimited thereby over the circumference. The gas is then blown out from the gas outlet pipe in the opposing direction to that in which it is suctioned through the gas inlet pipe. The deflection element is then configured on the first housing part 1 rather than on the second housing part 2. Moreover, the radial impeller may also be designed in any other desired manner from the radial impeller 5 shown in FIG. 9. In particular, the front wall 53 or the rear wall 54 may also be dispensed with. Preferably, for reasons of stability, however, both the front wall 53 and the rear wall 54 are present. The coupling piece 9 may also be configured in any other desired manner and, for example, comprise a flexible connecting hose. A plurality of further modifications is conceivable.

The invention claimed is:

1. A radial turbomachine comprising:

a first housing part which forms a motor chamber for accommodating a drive motor;

a second housing part which forms a gas inlet;

a flow channel which is jointly formed and delimited by the first housing part and the second housing part;

a gas outlet; and a radial impeller which is driveable about an axis of rotation by the drive motor in order to suction a gas from outside the turbomachine through the gas inlet into the flow channel and to convey said gas out of the flow channel through the gas outlet to the outside, wherein the first housing part or the second housing part forms the gas outlet at a radial distance from the axis of rotation and circumferentially delimits the gas outlet, wherein the first housing part and the second housing part are configured in each case in a substantially plate-shaped manner on an outer face in a region of the flow channel.

2. The radial turbomachine as claimed in claim 1, wherein, in each case, the first housing part and the second housing part are produced as a whole in one piece.

3. The radial turbomachine as claimed in claim 2, wherein, in each case, the first housing part and the second housing part are produced as a cast element.

4. The radial turbomachine as claimed in claim 1, wherein the gas outlet is an axial gas outlet.

5. The radial turbomachine as claimed in claim 1, wherein the second housing part or the first housing part comprises a deflection element which serves for deflecting the gas flowing out of the flow channel in a direction of the gas outlet.

6. The radial turbomachine as claimed in claim 5, wherein the deflection element is configured to effect a deflection of the flowing gas by 90°.

7. The radial turbomachine as claimed in claim 5, wherein the deflection element at least partially protrudes into the gas outlet.

8. The radial turbomachine as claimed in claim 1, wherein a sealing element is present between the first housing part and the second housing part in order to circumferentially seal the flow channel to the outside.

9. The radial turbomachine as claimed in claim 8, wherein the sealing element is circumferentially arranged around the gas outlet.

10. The radial turbomachine as claimed in claim 1, wherein the first housing part is produced from a metal.

11. The radial turbomachine as claimed in claim 10, wherein the second housing part is produced from a metal.

12. The radial turbomachine as claimed in claim 1, wherein the first housing part forms a compartment which is closable by a cover for accommodating an electronics unit.

13. The radial turbomachine as claimed in claim 1, additionally having a coupling piece in order to connect the gas outlet to the gas inlet of a further radial turbomachine.

14. The radial turbomachine as claimed in claim 1, wherein a space which is fully sealed to the outside, except for the gas inlet and the gas outlet, is delimited by the first housing part and by the second housing part, said space encompassing at least the flow channel.

15. The radial turbomachine as claimed in claim 14, wherein said space encompasses at least the flow channel and the motor chamber.

* * * * *